United States Patent [19]

Schiessl

[11] Patent Number: 4,890,670

[45] Date of Patent: Jan. 2, 1990

[54] CROSS-FLOW HEAT EXCHANGER

[75] Inventor: Gerhard Schiessl, Augsburg, Fed. Rep. of Germany

[73] Assignee: M.A.N. Maschinenfabrik Augsburg-Nurnberg Aktiengesellschaft, Augsburg, Fed. Rep. of Germany

[21] Appl. No.: 750,887

[22] Filed: Jul. 1, 1985

[30] Foreign Application Priority Data

Jun. 28, 1984 [DE] Fed. Rep. of Germany ..... 3423736

[51] Int. Cl.[4] ..... F28F 21/08; F28F 3/10

[52] U.S. Cl. ..... 165/76; 165/143; 165/166; 228/175; 228/183; 29/157.3 D

[58] Field of Search ..... 165/143, 166, 167, 76; 228/175, 183; 29/157.3 D

[56] References Cited

U.S. PATENT DOCUMENTS

| | | | |
|---|---|---|---|
| 799,621 | 9/1905 | Brewtnall | 165/166 |
| 1,914,604 | 6/1933 | Keenan, Jr. et al. | 165/166 |
| 2,240,203 | 4/1941 | Armacost | 165/166 |
| 2,787,446 | 4/1957 | Ljungstrom | 165/167 |
| 3,233,665 | 2/1966 | Rosenblad | 165/166 |
| 3,241,607 | 3/1966 | Rutledge | 165/166 |
| 3,247,899 | 4/1966 | Branch | 165/166 |
| 3,252,510 | 5/1966 | Blankenhorn | 165/166 |
| 3,265,129 | 8/1966 | Bawabe | 165/166 |
| 3,542,124 | 11/1970 | Manfredo | 165/166 |
| 4,099,928 | 7/1978 | Norback | 165/166 |
| 4,183,403 | 1/1980 | Nicholson | 165/166 |
| 4,301,863 | 11/1981 | Bizzarro | 165/166 |

FOREIGN PATENT DOCUMENTS

| | | | |
|---|---|---|---|
| 588741 | 11/1933 | Fed. Rep. of Germany | 165/167 |
| 1029016 | 4/1958 | Fed. Rep. of Germany | 165/143 |
| 46-10646 | 3/1971 | Japan | 165/166 |
| 1048122 | 11/1966 | United Kingdom | 165/166 |

*Primary Examiner*—John Ford

*Attorney, Agent, or Firm*—Frishauf, Holtz, Goodman & Woodward

[57] ABSTRACT

To permit high-temperature differential cross flow of an initially cool, heat absorbing medium and an initially hot, heat releasing medium, with temperature differences in the order of 1000° and higher, and to prevent localized thermal overload, the heat exchanger is a two-stage heat exchanger, with plate packages (5, 6) which are serially passed by the media, typically gaseous media. The first package (5) forms a preheater stage and the second package (6) forms a final heater stage. Connecting ducts (9, 10) are provided and so arranged that the initially hot fluid medium is conducted through flow channels in the second heater stage which receives heat absorbing medium which has already passed through the preheater stage, so that it has already been preheated, thereby reducing the temperature difference between the preheated heat absorbing medium and the initially hot, heat releasing medium. The heat releasing medium, having been cooled in the final heater stage, is then passed to the preheater stage where it transfers heat to the initially cool heat absorbing medium, which is directed to its inlet. The plate packages comprise flat plates, formed with corrugations, for example extending at an angle of 30° with respect to the flow direction of the fluid.

13 Claims, 4 Drawing Sheets

CROSS-FLOW HEAT EXCHANGER

The present invention relates to a cross-flow heat exchanger, and more particularly to a heat exchanger in which heat is transferred from one gaseous medium to another, and in which the difference in temperature between the hot, heat releasing fluid medium, typically a gas, is substantially hotter than the initally cool, heat-absorbing fluid medium, typically also a gas. The temperature differences may be in the order of 1000° C., or even higher.

BACKGROUND

The problem in heat exchangers in which the temperature difference between the incoming, initially cool, heat absorbing fluid and the heat transferring, that is, heat-releasing fluid, is very high is best illustrated in connection with the diagram of FIG. 1. A typically prior art heat exchanger is shown in FIG. 1, in which a hot heat releasing gas is passed across one surface of a heat exchange plate 1 in the direction of the arrow 2. Suitable flow ducts and the like have been omitted from the schematic showing of FIG. 1 for ease of illustration. The heat is transferred to a gas which flows in direction of the arrow 3. The ducts between the hot gases, arrow 2, and the to-be-heated gases, arrow 3, cross each other.

The heat releasing gas enters at a temperature of between about 900° C. to 1100° C. in the heat exchanger, and leaves the heat exchanger at a temperature of about 200° C. to 250° C. The gas to be heated is raised from about room temperature, for example from up to about 50°, to a temperature of between 800° C. to 950° C. In the explanation hereinafter, reference will be made simply to a "gas" although, of course, other fluid media may be used, and the "gas" may be a fluid gaseous medium, for example steam.

The temperature relationships above explained result in substantial temperature differences, and, for example, the corner 4 (FIG. 1) will have a temperature difference of over 1000° C. occurring across the heat exchange plates or ducts. This situation arises since on the one side of the corner 4, the hot gas in flow 3 is applied and at the other side thereof, immediately adjacent thereto, the initially cold medium, see arrow 3, is passed. This substantial temperature difference places high stresses on the separating elements, and plate-type heat exchangers of known construction could not accept this temperature drop thereacross. The plates would, in the regions of substantial temperature difference, twist or bend, and forces which arose were so great that connections made by soldering, brazing, or welding would tear. It has been tried to solve the problem by use of particularly high-quality materials when making the plate heat exchanger components. Even heat exchanger components made of highest-quality material, resistant to high temperature, thermal shocks and thermal differences could not solve the problem entirely. Such high-quality materials usually additionally were very expensive, using alloys based on nickel or cobalt. The lifetime of cross-flow heat exchangers subjected to substantial temperature differences could be increased, but deformation, twisting and heat induced changes in dimensions of the heat exchanger components as well as tearing of connections could not be entirely avoided, particularly in the region of the critical corners 4, for example.

THE INVENTION

It is an object to provide a cross-flow heat exchanger which can accept extreme differences in temperature between the heat-releasing fluid medium and the heat absorbing fluid medium, for example temperature differences of 600° C. and up to over 1000° C., and which is not subject to deformation or failure of connections between the various heat exchanger components, especially at critical points such as corners or the like.

Briefly, the heat exchanger is constructed as a multi-stage heat exchanger, typically a two-stage heat exchanger, which is built up of two serially—with respect to flow—connected packages of plates. A first one of the packages forms a preheater stage, and a second one a final heater stage. Both plate packages—which are physically separated—are connected by suitable connecting ducts. The plate packages themselves are made of similar plates which are corrugated at an angle with respect to the flow direction, and separated from each other by edge strips, in which the edge strips are located at right angles to each other, if the plate packages are rectangular, for example, to define a flow path in one direction for the heat-releasing medium and a flow path in a direction transverse thereto for the heat-accepting or heat absorbing medium.

The arrangement has the advantage that each stage need accept temperature differences which are substantially less than a single-stage construction. Due to the multi-stage construction, the temperature difference across the heat exchanger plates forming the package are substantially less than in a single-stage device, so that the materials can easily accept the temperature differences across the thickness thereof, and undesired deformation, twisting or separation of components is effectively avoided. Subdividing the cross-flow plate heat exchanger into a preheater stage and a final heater stage, additionally, results in a simple construction which can be made economically in large quantities, by using identical components, suitably arranged to provide for the respective flow paths by appropriate placement of the edge strips.

DRAWINGS

DETAILED DESCRIPTION

Figure 2:
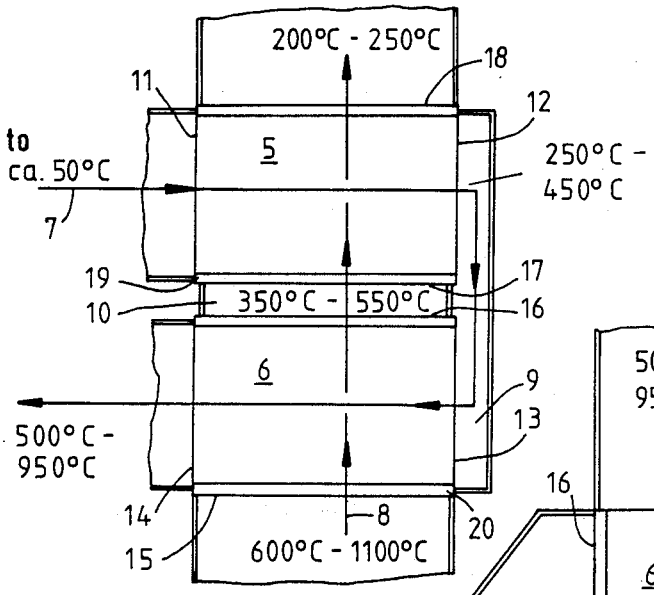
FIG. 2 is a schematic diagram of the structure in accordance with the present invention, and showing the heat relationships arising therein.
Figure 3:
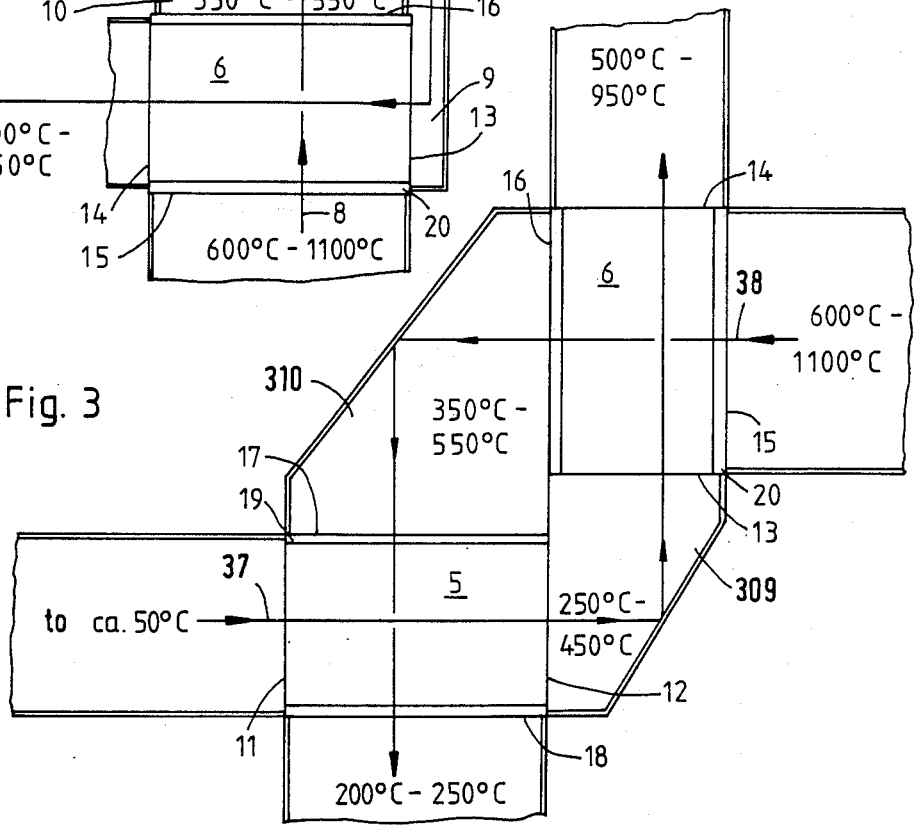
FIG. 3 is a schematic diagram illustrating another arrangement of a heat exchanger in accordance with the invention.

The heat exchanger in accordance with the present invention—see FIGS. 2 and 3—is formed of two serially connected plate packages 5, 6. The first plate package 5 forms a pre-heater stage; the second plate package 6 forms a final heater stage. The heat-absorbing or heat-accepting medium flows in accordance with the direction of the arrow 7; the heat releasing medium flows in accordance with the arrow 8. As can be seen, the flow directions cross each other.

The heat accepting medium flowing in accordance with the arrow 7 may, for example, be air used in a combustion process; the heat releasing medium 8 may be hot exhaust gases resulting from the combustion process, for example smoke or cleaned combustion exhaust gases derived from a furnace, boiler, or the like. The plate package 5, forming the preheater stage, is physically separated from the final heater stage formed by the plate package 6. It is spaced therefrom, and the heater packages 5, 6 are connected by two separate connection ducts. A first connection duct 9 connects the heat absorbing medium in the flow path 7 from the package 5 to the package 6. A second connection duct 10 connects the heat releasing medium 8 from the package 6 to the package 5. The connection of the connecting ducts 9, 10 to the plate package 5, 6 is so arranged that the heat—absorbing medium—flow path 7—enters at one edge surface 11 of the preheater stage of the plate package 5. The heat absorbing medium leaves the heat exchanger at the other end face 12 and is conducted by the first connection duct 9 to the end surface 13 forming an inlet opening for the final heating stage of the plate package 6. After flowing through the plate package 6, the heat accepting medium leaves at outlet openings formed at the edge surface 14.

The heat-releasing gas enters at an inlet at the cross side 15 of the final stage, that is, of plate package 6, flows through the final stage and, after having released some of the heat, and being cooled by the heat exchange, leaves the final stage at an outlet at the end face 16, is conducted by the second connection duct 10 to the inlet at the face 19 of the first plate package, flows therethrough, and leaves the first plate package at an outlet formed by the edge 18 of the first plate package 5.

OPERATION, AND TEMPERATURE RELATIONSHIPS

The temperature relationships in the heat exchanger in accordance with the present invention are such that the gaseous heat-releasing medium enters the final heating stage at a temperature of between 600° C. to 1100° C. by being conducted to the inlet at end face 15, that is, adjacent to the inlet region 20 of the heat exchanger plate package 6, and releases heat to the heat-accepting medium. At the outlet surface 16, and, hence, essentially also at the inlet surface 17 of the plate package 5, the temperature of the heat-releasing medium will then be between 350° C. to 550° C. It transfers further heat to the heat accepting medium in the plate package 5 and, upon leaving the plate package 5, will have a temperature of between 200° C. to 250° C. The heat-accepting medium, see flow 7, enters the inlet face 11 of the plate package 5 with a temperature of about room temperature to about 50° C. It is preheated in this preheater package 5 and will leave the preheater package 5 at a temperature somewhat below that of the entry temperature of the heat-releasing medium, that is, at a temperature of between 250° C. to 450° C. When it leaves the exit face 12, it is conducted by the first duct 9 to the entry face 13 of the final heater stage 6. There is very little heat loss in the heat ducts which, preferably, are insulated. As the heat accepting medium flows through the plate package 6, it is further heated to a temperature of between about 500° C. to 950° C., which will be the outlet temperature at the outlet face 14.

Due to the two-stage construction of the cross-flow heat exchanger, the critical end regions 19, 20 of the plate package 5, 6 will have temperature differences which always will be less than 650° C., a temperature difference which can readily be handled by materials customarily used in cross-flow plate-type heat exchangers.

In accordance with a feature of the invention, the plate packages 5, 6 each comprise a plurality of thin plates 21—see FIGS. 4 to 7—and narrow edge strips 23. The plates 21 have a flat end zone 22 and a corrugated central zone, in which corrugations are formed to increase the surface. The corrugations extend at an angle with respect to the flow direction of the medium. They are straight, and extend parallel to each other, and have a height $h_S$ from the flat or central or medium plane, which also corresponds to the plane of the flat end zone 22. The height of the corrugation $h_S$ is half the height $h_K$ of a flow duct between two adjacent plates. The plates are secured together, and adjacent plates form the flow ducts by connecting the plates, in accordance with a feature of the invention, by small end strips 23 (which have a thickness $h_R$) which is the same as the height $h_K$ of the flow duct.

Figure 4:
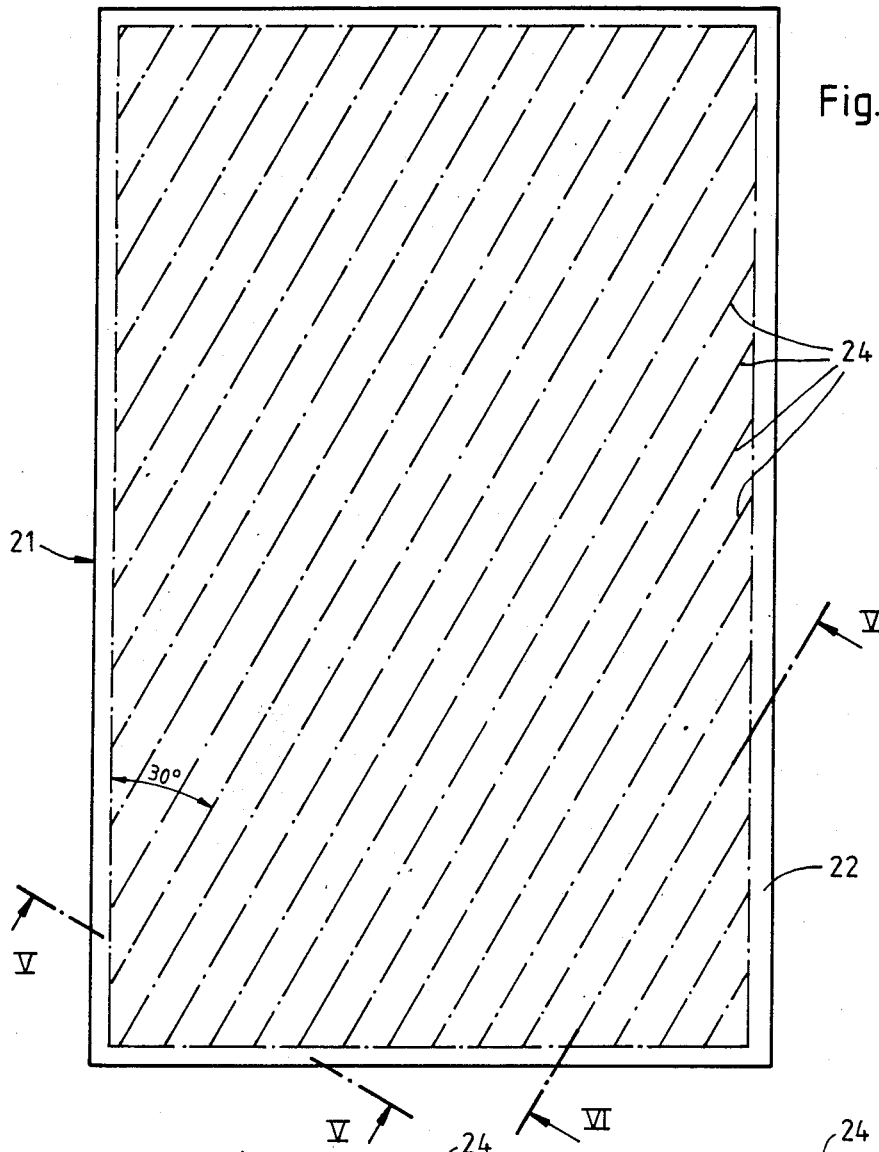
FIG. 4 is a schematic top view of a plate of a heat exchanger.
Figure 5:
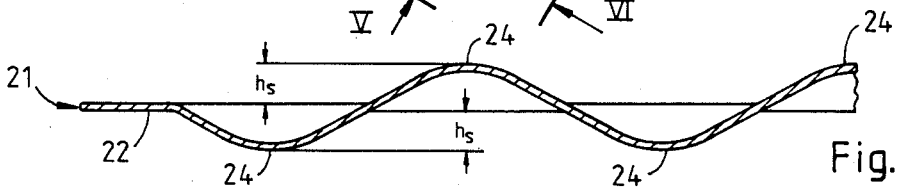
FIG. 5 is a section through section line V—V of FIG. 4.
Figure 6:
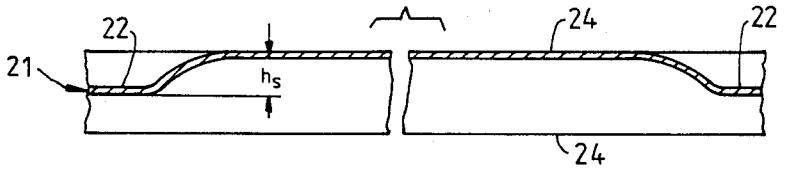
FIG. 6 is a section along section line VI—VI of FIG. 4.

FIGS. 4 to 6 show details of the plates 21. FIG. 4 is schematic, and the corrugations 24 are merely schematically shown by chain-dotted lines, which may indicate the tops or crests of the corrugations and the adjacent troughs, respectively.

FIGS. 5 and 6 show the actual construction of the plates 21, and the formation of the corrugations, FIGS. 5 and 6 being section lines along sections 5—5 and 6—6 of FIG. 4.

Figure 7:
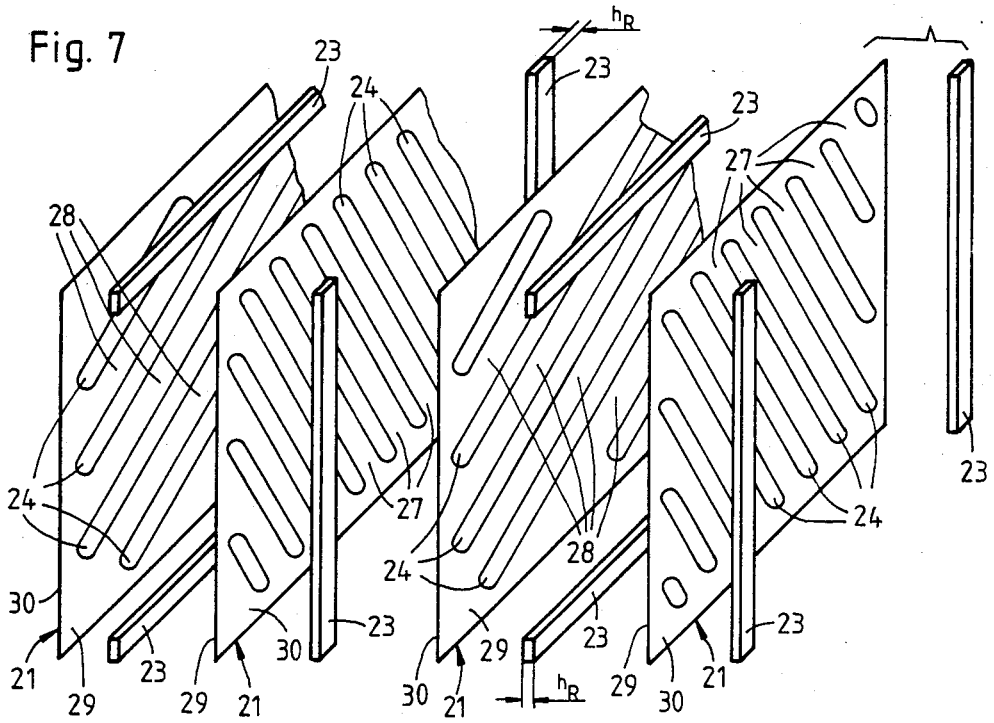
FIG. 7 is an exploded, schematic view, in perspective, partly schematic, of a plate package construction of any one of the stages, prior to assembly.
Figure 8:
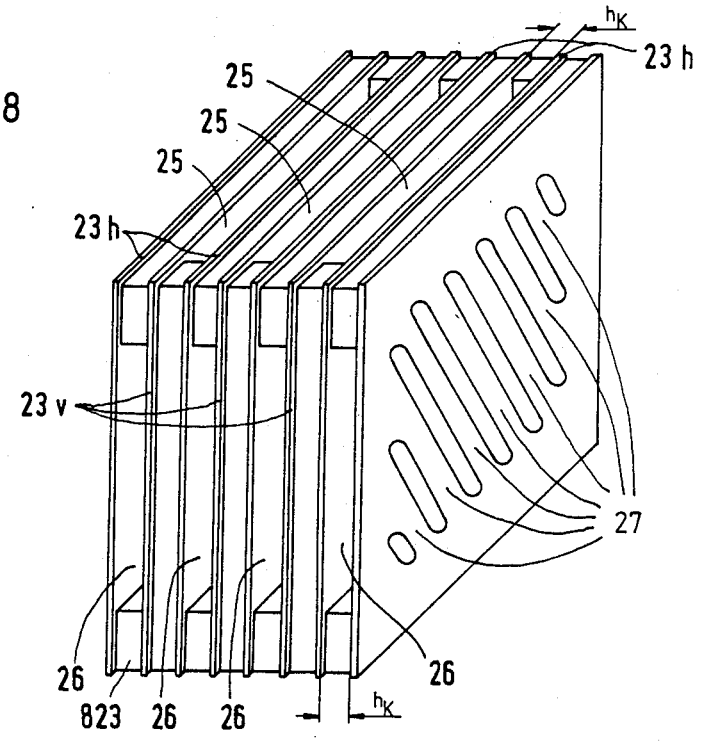
FIG. 8 is a perspective view of the assembly of FIG. 7, however to a different scale.

The height of the corrugation, with respect to the medium plane, is shown in FIGS. 5 and 6 as $h_S$. The thickness $h_R$ of the edge strips 23 is shown in FIG. 7 by the dimension arrows thereof, and the arrangement is best seen in FIG. 8, in which, however, the height $h_K$ of the flow ducts as well as the thickness of the strips is exaggerated for ease of visualization. The respective flow ducts 25, 26 will have a width which is twice the height $h_S$ of the corrugation 24, mathematically:

$$(h_K = h_R = 2h_S).$$

As best seen in FIGS. 7 and 8, the plates 21 of a plate package 5 or 6—the packages can be identical—form the flow ducts 25, 26 therein for, respectively, the heat releasing medium and the heat accepting medium, thereby forming heat releasing ducts 27 and heat accepting ducts 28; the plates 21 are stacked above each other, but rotated with repect to each other. In the arrangement shown, in which the angle of the corrugations 24 with the edge is about 30°—shown in FIG. 4—the plates are offset with respect to each other by 180°, so that the front side 29 of a plate 21 faces the front side 29 of an adjacent plate 21, rotated by 180°, so that the top side of a first plate 21 is adjacent the bottom edge 30 of the next plate 21—see FIG. 7, going, for example, from left to right. The pattern will repeat—see FIG. 7—and with the dimensions given, the corrugations 24 of two adjacent plates 21 will cross and, in the crossing region, will have point contact with each other. For lateral limitation of the ducts 25, 26, the edge strips 23 are inserted in the end zones 22, alternately extending vertically—as shown by strips **23*v*, FIG. 8, and horizontally, as shown by strips 23*h*. The plate packages are pre-assembled. At the overlapping regions of the edge strips 23, that is, in the corner regions of the plate packages 5 and 6, the plates 21 and the edge strips 23 are welded together; the plates and the edge strips 23 are soldered or brazed along the longitudinal edges of the strips 23, that is, along the sides 22** of the plates.

Figure 9:
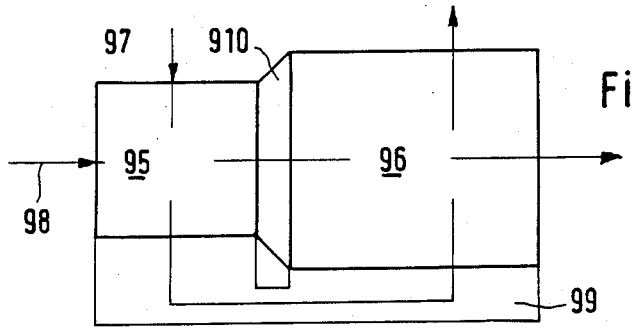
FIG. 9 is a schematic arrangement illustrating plate packages of different size.

Many changes and modifications may be made, and various arrangements of plates and plate packages 5, 6 are possible. Particularly, the plate package 6 which forms the final heating stage may be assembled with plates 21 which are larger than the plates forming the preheating package 5, that is, which have a greater length or width, or both, respectively. FIG. 9 illustrates such an arrangement, in which all reference numerals correspond to those of FIG. 2, incremented by the first digit "9". The connecting ducts 99, 910 match the respective cross sections.

Figure 10:
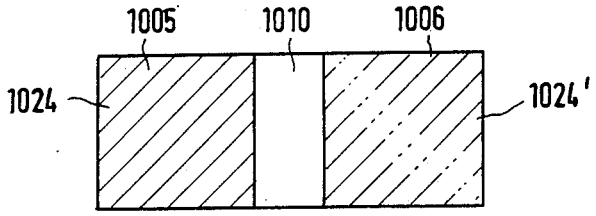
FIG. 10 is a schematic top view illustrating plate packages having different corrugations.

The corrugations 24 on the plates 21 in the edge strips 23 of one plate package, for example the plate package 105 (FIG. 10), may have a different height than the corrugations of the plates of the other plate package, for example the plate package 1006. FIG. 10 shows, schematically, corrugations 1024 for plate package 1005, connected by ducts 1010 with the plate package 1006 which has different corrugations, 1024'.

Figure 1:
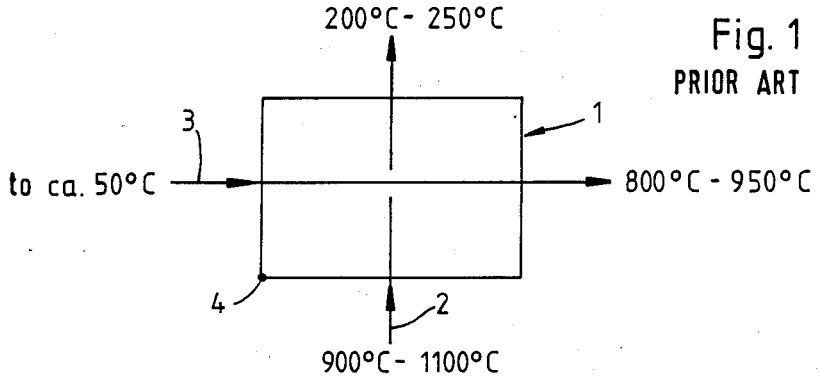
Fig. 1 PRIOR ART
FIG. 1 is a schematic diagram showing heat relationships in accordance with a prior art heat exchanger.

In FIG. 1, the plates 21 are rectangular, having a longitudinal side which is approximately 1.5 times that of the width. The wider sides of the plate 21 extend in the direction of the flow duct 26, limited by the edge strips 23 located in the flat end region 22 of the plates 21. The edge strips 23 are slightly shorter than the length of the sides along which they extend, so that they can be set back by about ½ mm with respect to the edge of the plates. This permits the plates to extend slightly over the edge strips and form a groove or trough which insures that solder or hard solder will flow reliably and securely connect the edge strips 23 to the plates 21, and, additionally prevents uncontrolled flow-off of solder material and, then, flow of solder material to points where it is not desired. The overlap is shown at 823 in FIG. 8.

The corrugations 24 in the plates 21 are angled by about 30° with respect to the longitudinal sides of the plates, see FIG. 4. This will result in a flow duct 26 for the heat releasing medium in which the corrugations form an angle of 60° with respect to the flow direction of the gas flowing through the duct 26. The corrugations will form an angle of 30° with respect to the direction of flow of the heat accepting medium, as seen by the corrugations in the flow channel or flow duct 25.

A particularly compact arrangement is obtained if the plate packages 5 and 6 are located as shown in FIG. 2, that is, the inlet for the heat accepting gas is located at the same side as the exit for the heat accepting gas at the final stage of the package 6. This requires that the connection duct 9 is so arranged that the heat accepting medium must be deflected twice by 90°. An easier arrangement of connecting ducts can be obtained by arranging the two plate packages 5, 6 at least with their longitudinal sides parallel to each other. It is also possible to so arrange the plate packages that the plate package 5 forming the preheating stage has its edge 12 which forms the exit face located in a single plane with the inlet of the final stage of the plate package 6, so that for the flow path a simple connection duct 9 can be used which is box-shaped. The connection duct 10 which extends between the facing side 16 of the final stage package 6 and the side 17 which forms the plate package 5 of the preheater stage, then, likewise, can be box-shaped.

FIG. 3 illustrates another modification in which the plate packages 5, 6 are offset with respect to each other and so arranged that each medium, after passing the plate package 5, 6 in the respective flow direction, is conducted through connection ducts 310, 309, respectively, and then passes through the subsequent plate package 6, 5, respectively, in a direction which extends under an angle to the prior flow direction of less than 180°, in the embodiment shown of 90°, see flow paths 37, 38. As best seen in FIG. 3, the two plate packages 5, 6 are rotated 90° with respect to each other, and connected by the respective connection ducts 310, 309.

Figure 11:
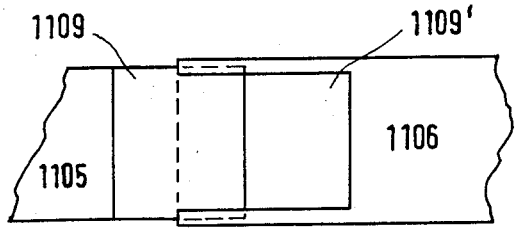
FIG. 11 is a schematic side view showing relatively movable connecting ducts.

In general, and dependent on the respective arrangement of the plate packages 5, 6, the connection ducts 9, 10 or 309, 310 . . . etc. may be formed by fixed walls, rigidly installed; the walls may also be of mutually slidable wall plates, in which one plate component is coupled to a plate package 5 and the other plate component is coupled to the plate package 6, to permit relative movement under differential thermal expansion and contraction. FIG. 11 shows a suitable arrangement, in which a plate 1109 extending towards the package 1106 is secured to the package 1105. A plate 1109' extends from the plate package 1106 towards the plate package 1105, and is formed with a U-shaped edge which overlaps and engages over the plate 1109, to permit sliding movement of the plates with respect to each other but provide for a gas-tight guidance, for example by means of a sealing strip or the like as well known.

The plate packages 5 and 6 may, in one illustrative example, be built up of about 150 stacked plates having a thickness of 0.2 mm, with corrugations having a corrugating depth $h_S$ from the medium plane, that is, from the edge strip 22, of about 2 mm. The clearance of the flow ducts then will be about 4 mm, which will also be the thickness of the strips 23.

The plates need not be the same size; FIG. 9 illustrates two plate packages 95, 96, connected by ducts 99, 910, through which media flow in the flow path 97, and 98, respectively. The final heater stage, that is, heater stage 96, has an effective heat transfer which is greater than the effective heat transfer of the surface of the plates forming the preheater stage. This effect can also be obtained by forming different corrugations—see FIG. 10—in the plates, in which the pre-heater stage 1005 has corrugations 1024 formed therein which are less deep, or have a lesser dimension $h_S$ than the corrugations 1024' of the final heater stage 1006. The heater stages are joined by duct 1010. All other arrangements may be similar and have been omitted from the schematic drawing for clarity. The duct walls, as best seen in FIG. 11, may be single rigid connecting plates, or may be flexible ducts; in accordance with a feature of the invention, a preheater stage 1105 has its plate package connected to a duct wall plate 1109. The final heater stage package 1106 has a duct plate 1109' connected thereto which is formed with an open channel-like edge crimp fitting over the flat plate 1109, so that the two plates are relatively slightly movable to allow for differential expansion and contraction as the plate packages are subjected to respectively different temperatures.

Figure 12:
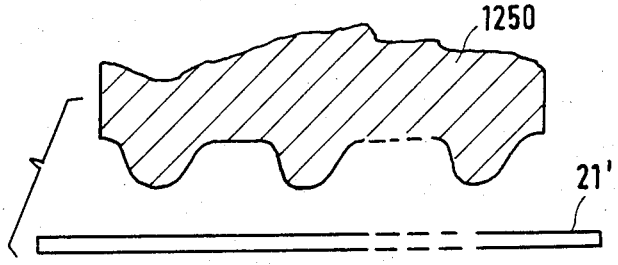
FIG. 12 is a schematic view of a punch tool about to punch a plate to form corrugations therein.

In accordance with a feature of the invention, the plates can all be identical, or, at least, start with originally identical flat plates 21' (FIG. 12), and then punched by a punch 1250. The depth of penetration of the punch into the plate 21' may differ in dependence upon how deep the corrugations are to be, as explained, for example, with respect to the corrugations 1024, 1024', respectively, FIG. 10.

Other variations between the plates of one package and the other may be made; for example, the material of the plates and of the edge strips of one plate package may differ from that of another plate package from point of view of quality; the final heater stage, subjected to the hottest fluid medium, will receive the best quality material; for lesser temperature ranges, cheaper materials, of lesser heat-resistant material, are sufficient. Suitable materials are copper, stainless steel, and various well known other materials in the heat exchange field, for example nickel and/or cobalt alloys.

The number of plates in any one plate package may also differ from that in another plate package. Again, the plate package forming the final heater stage 6 will contain more plates than the plate package forming the preheater stage 5. If the corrugations differ—see FIG. 10—then the corrugations 1024 in the plates forming the preheater stage 1005 may be more shallow than the corrugations 1024' of the final heater stage 1006. The general shape of the corrugations may be the same, and the difference in height can readily be accomplished by limiting the downward thrust or stroke of the punch 1250 (FIG. 12) into the blank plate 21'.

As illustrated in FIGS. 2 and 3, the plates are preferably rectangular, and have a length which is about 1.5 times its width. The flow ducts which are defined by the edge strips 23, through which the heat releasing medium flows, then preferably extend along the width side of the plates 21, and the strips which define the flow ducts or channels 25 through which the heat absorbing, or heat accepting gaseous medium flows, should extend along the length or longer sides of the plates 21.

Various changes and modifications may be made, and features described in connection with any one of the embodiments may be used with any of the others, within the scope of the inventive concept.

I claim:

1. High-temperature cross-flow heat exchanger for transfer of heat from an initially hot, heat releasing fluid medium to an initially cool, heat absorbing fluid medium having a plurality of plates assembled in a plate package with adjacent plates defining therebetween flow ducts or channels (25, 26, 27, 28) for the fluid media, said package (5, 6) having inlets and outlets, wherein the plate package comprises:

a plurality of thin plates of good heat conductive material, said plates being formed with parallel corrugations (24), the corrugations terminating short of the edge zones of the plates and having a corrugation height ($h_S$) extending from a median plane of said plates which is half the thickness ($h_K$) of the flow ducts (25, 26) formed between adjacent plates, each of said plurality of plates having a top side (29) and a bottom side (30), said edge zones of the plates being flat and extending along the entire periphery of said plates, and flat, elongated edge strips (23, **23*v*, 23*h*) having a thickness ($h_R$) corresponding to the thickness ($h_K$) of the flow ducts, said plates (21) being assembled into the respective packages with the corrugations (24) of one surface (29) of a plate (21) crossing the corrugations (24) on a facing surface (30) of an adjacent plate, the corrugations (24) of the adjacent plates, at crossing points, being in point contact with each other, said plates being so stacked that the top side (29) of a plate (21) is opposite a top side (29) of a further plate (21) rotated by 180° relative thereto, and the then uppermost bottom side (30) of said further plate (21) engaging the bottom side (30) of another plate and so on, in all following plates, so that the corrugations (24) of two respectively superposed plates (21**) cross each other and form said point contact;

the inlets and outlets of the packages being located in alignment with each other to define the respective flow directions of the respective medium, said flow directions extending at an angle with respect to and crossing the corrugations of the plates, a first set of two of said edge strips (**23*h*) being fitted between adjacent plates at opposite respective edge zones thereof to define each heat accepting duct (28) for the heat absorbing medium to flow therethrough in a direction parallel to the respective edge strips (23*h*) at the sides of the ducts, and a second set of two of said edge strips (23*v*) being fitted between adjacent plates at opposite respective edges thereof to define each heat releasing duct (27) adjacent a heat accepting duct for heat releasing medium to flow therethrough at an angle with respect to the flow of the medium through the heat accepting duct and in a direction parallel to the respective edge strips (23*v*), the edge strips of said first set overlapping, respectively, the edge strips of said second set only at corners of said plates, wherein, to accomodate extreme temperature differences between the heat-releasing medium and the heat-absorbing medium at adjacent corners of said heat exchanger, the corner regions of the plates (21) and the overlapping regions of said edge strips (23*v*, 23*h*) interposed between adjacent plates, are welded together whereby the corner regions of the plates and the overlapped regions of the edge strips will form weld-connected corners, and wherein the plates (21) and the edge strips (23*v*, 23*h*) interposed between adjacent plates are soldered along the longitudinal edges of the edge strips (23) and along the sides of the plates (21**), whereby said edge strips and plates will be joined between said welded corners and along the length of the edge strips by soldering.

2. The heat exchanger of claim 1, wherein the angle which the corrugations form with respect to the edge strips (23) is about 30°.

3. The heat exchanger of claim 1, wherein the plates (21) forming the plate package (5, 6) comprises rectangular plates.

4. The heat exchanger of claim 3, wherein a longer side of the rectangular plates (21) is about 1.5 times the length of a width side of the rectangular plates.

5. The heat exchanger of claim 3, wherein the edge strips of the first set (23*h*) define the heat accepting ducts (28) and extend along the width of the plates (21); and the edge strips of the second set (23*v*) define the heat releasing ducts (27) and extend along the longer side of the plates (21).

6. Heat exchanger according to claim 1, wherein the plates (21) are rectangular;

the angle which the corrugations (24) form with respect to a first side of the plates is about 30°, whereby the angle which the corrugations form with respect to a second side, perpendicular to said first side, will be about 60°;

means are provided for directing the heat-absorbing medium between plates from said first side so that said heat-absorbing medium will flow through a duct (26) which has the corrugations extending at an angle of 30° with respect to the flow direction of the heat-absorbing medium; and means are provided for directing the heat-releasing medium between said plates from said second side so that the heat-releasing medium will flow through a second duct (25) in which the corrugations extend at an angle of 60° with respect to the flow direction of the heat releasing medium.

7. The heat exchanger of claim 1, wherein the plates comprise rectangular plates having long sides and relatively shorter width sides, and wherein said plates are arranged in packages;

the angle which the corrugations (24) form with respect to a long side thereof is about 30°;

means for directing the heat-absorbing medium between adjacent plates from the long side, so that the entering flow direction of said heat-absorbing medium will be at an angle of approximately 30° with respect to the corrugations; and means for directing the heat-emitting medium between the short sides so that the entering flow direction of the heat-emitting medium will form an angle of approximately 60° with respect to said corrugations.

8. High-temperature cross-flow heat exchanger for transfer of heat from an initially hot, heat releasing fluid medium to an initially cool, heat absorbing fluid medium having a plurality of plates assembled in a plate package with adjacent plates defining therebetween flow ducts or channels (25, 26, 27, 28) for the fluid media, said package (5, 6) having inlets and outlets, wherein the plate package comprises:

a plurality of thin plates of good heat conductive material, said plates being formed with parallel corrugations (24), the corrugations terminating short of the edge zones of the plates and having a corrugation height ($h_S$) extending from a median plane of said plates which is half the thickness ($h_K$) of the flow ducts (25, 26) formed between adjacent plates, each of said plurality of plates having a top side (29) and a bottom side (30), said edge zones of the plates being flat and extending along the entire periphery of said plates, and flat, elongated edge strips (23, 23*v*, 23*h*) having a thickness ($h_R$) corresponding to the thickness ($h_K$) of the flow ducts, said plates (21) being assembled into the respective packages with the corrugations (24) of one surface (29) of a plate (21) crossing the corrugations (24) on a facing surface (30) of an adjacent plate, the corrugations (24) of the adjacent plates, at crossing points, being in point contact with each other, said plates being so stacked that the top side (29) of a plate (21) is opposite a top side (29) of a further plate (21) rotated by 180° relative thereto, and the then uppermost bottom side (30) of said further plate (21) engaging the bottom side (30) of another plate and so on, in all following plates, so that the corrugations (24) of two respectively superposed plates (21) cross each other and form said point contact;

the inlets and outlets of the packages being located in alignment with each other to define the respective flow directions of the respective medium, said flow directions extending at an angle with respect to and crossing the corrugations of the plates, a first set of two of said edge strips (23*v*) being fitted between adjacent plates at opposite respective edge zones thereof to define each heat accepting duct (28) for the heat absorbing medium to flow therethrough in a direction parallel to the respective edge strips (23*v*) at the sides of the ducts, and a second set of two of said edge strips (23*h*) being fitted between adjacent plates at opposite respective edges thereof to define each heat releasing duct (27) adjacent a heat accepting duct for heat releasing medium to flow therethrough at an angle with respect to the flow of the medium through the heat accepting duct and in a direction parallel to the respective edge strips (23*h*), the edge strips of said first set overlapping, respectively, the edge strips of said second set only at corners of said plates, a heat accepting duct for heat releasing medium to flow therethrough at an angle with respect to the flow of the medium through the heat accepting duct and in a direction parallel to the respective edge strips (23*v*), the edge strips of said first set overlapping, respectively, the edge strips of said second set only at corners of said plates, wherein, to accomodate extreme temperature differences between the heat-releasing medium and the heat-absorbing medium at adjacent corners of said heat exchanger, the corner regions of the plates (21) and the overlapping regions of said edge strips (23*v*, 23*h*) interposed between adjacent plates, are welded together whereby the corner regions of the plates and the overlapped regions of the edge strips will form weld-connected corners, wherein the plates (21) and the edge strips (23*v*, 23*h*) interposed between adjacent plates are soldered along the longitudinal edges of the edge strips (23) and along the sides of the plates (21), whereby said edge strips and plates will be joined between said welded corners and along the length of the edge strips by soldering; and wherein the edge strips (23) are set back from the edges of the plates (21) by a slight distance in the order of about ½ mm to ensure flow of solder medium along the junction between the edge strips and the plates.

9. Heat exchanger according to claim 8, wherein the angle which the corrugations form with respect to the edge strips is about 30°.

10. Heat exchanger according to claim 8, wherein the plates (21) forming the plate package (5, 6) comprise rectangular plates.

11. Heat exchanger according to claim 10, wherein a longer side of the rectangular plates (21) is about 1.5 times the length of a width side of the rectangular plates.

12. Heat exchanger according to claim 10, wherein the edge strips of the first set (23*h*) extend along the width of the plates (21) and define the heat accepting ducts (20) and the edge strips of the second set (23*v*) extend along the length or longer side of the plates (21) and define the heat releasing ducts (27)

13. Heat exchanger according to claim 8, wherein the plates (21) are rectangular;

the angle which the corrugations (24) form with respect to a first side of the plates is about 30°, whereby the angle which the corrugations form with respect to a second side, perpendicular to said first side, will be about 60°;

means are provided for directing the heat-absorbing medium between plates from said first side so that said heat-absorbing medium will flow through a duct which has the corrugations extending at an angle of 30° with respect to the entering flow direction of the heat-absorbing medium; and means are provided for directing the heat-releasing medium between said plates from said second side so that the heat-releasing medium will flow through a second duct (27) in which the corrugations extend at an angle of 60° with respect to the entering flow direction of the heat releasing medium.

* * * * *